United States Patent [19]

Seaman

[11] 4,441,391

[45] Apr. 10, 1984

[54] APPARATUS FOR SEVERING AN ARTICLE FROM A CARRIER AND FOR POSITIONING THE SEVERED ARTICLE

[75] Inventor: Gary G. Seaman, Broomfield, Colo.

[73] Assignee: AT&T Technologies, Inc., New York, N.Y.

[21] Appl. No.: 488,899

[22] Filed: Apr. 27, 1983

[51] Int. Cl.[3] ..... B65H 35/06

[52] U.S. Cl. ..... 83/165; 83/405; 83/255; 83/41; 83/694

[58] Field of Search ..... 83/165, 405, 255, 41, 83/49, 50, 694

[56] References Cited

U.S. PATENT DOCUMENTS

| | | | |
|---|---|---|---|
| 1,426,470 | 8/1922 | Fray | 83/694 |
| 1,923,937 | 8/1933 | Kruse | 83/694 |
| 3,000,249 | 9/1961 | Foskett | 83/165 |
| 3,839,935 | 10/1974 | Daniels | 83/165 |
| 4,085,639 | 4/1978 | Marconi | 83/690 |

*Primary Examiner*—James M. Meister
*Assistant Examiner*—J. L. Knoble
*Attorney, Agent, or Firm*—J. J. Jordan; R. F. Kip, Jr.

[57] ABSTRACT

Apparatus 30, FIG. 2 for severing an article 12 from a carrier strip 10 and for positioning the severed article is disclosed. The apparatus includes a die 33 having an aperture 32 exiting therethrough from an entrance end 35 to an exit end 36. A ramped shaped wall 37 is located on one surface of the aperture to taper the aperature as it extends from the entrance end to the exit end such that the exit end has a rectangular block "C" shaped opening. A punch 31 in axial alignment with the aperture for entering into and extending through the aperture, has a cavity 43 on one surface to accept ramped shaped wall 37 as punch 31 extends into aperture 32 and to form a block "C" shaped surface on the bottom face 42 of punch 31. When an article 12 is placed between punch 31 and aperture 32 and punch 31 is moved into the aperture, article 12 is severed from carrier strip 10 and is pushed by face 42 into the aperture. As the punch 31 moves into aperture 32, ramped shaped wall 37 moved the severed article 12 to position it at exit end 36 of aperture 32.

2 Claims, 6 Drawing Figures

APPARATUS FOR SEVERING AN ARTICLE FROM A CARRIER AND FOR POSITIONING THE SEVERED ARTICLE

TECHNICAL FIELD

This invention relates to apparatus for severing an article connected to a carrier and for precisely positioning the severed article, and more particularly, to apparatus for severing a contact finger from a carrier strip and for precisely positioning the severed contact finger.

BACKGROUND OF THE INVENTION

Some printed wiring boards have contact fingers arranged along an edge of the board for providing an electrical connection with contact positions of an edge board connector when the finger-bearing edge is inserted into the connector. One end of each contact finger is in electrical and physical contact with a circuit located on the board while the other end of the finger provides an electrical path to a particular contact position in a connector upon insertion into the connector. Thus the fingers act as electrical bridges for circuitry on the board to interact with all the remainder of the circuitry in the sytem not located on the board.

The electrical contact fingers are typically provided on a web with each finger located between two carrier strips in a bandolier fashion. The web, rolled onto a reel, is fed by a stepping motor into a punch where the fingers are removed from the carrier strips for placement onto the circuit board edge. The operation of the stepping motor and the location of the finger on the web combine to provide a tolerance of ±0.015 inches (0.38 mm) for positioning the severed finger on the board edge and this tolerance was sufficient for finger placement when relatively few fingers were required.

However, as components have become smaller circuit boards are being designed to hold a greater number of circuits which require a larger number of contact fingers to be placed along the edge of the board for electrical connection. Consequently fingers have become thinner with the fingers crowded together so as to be able to physically locate a larger number of fingers along the board edge. Each thinner finger must be precisely positioned on the circuit board edge to provide proper electrical connection with circuitry located on the board without touching an adjacent finger in the crowded environment. Whereas fingers can be positioned with ±0.015 inch tolerance using the fingers' position on the carrier as a guide, present boards, requiring positioning within ±0.003 inch (0.08 mm) tolerance, do not permit the same positioning technique to be used.

Thus a problem exists in that apparatus is required to sever a finger from a web which finger is not accurately located and to precisely position the finger after it has been severed.

SUMMARY OF THE INVENTION

The above problems are solved by the present invention in which apparatus for severing and then positioning articles supplied by a carrier comprises a die having an aperture extending axially therethrough between entrance and exit openings of the aperture, the aperture being bounded in its interior on longitudinally opposite sides of its axis by planar wall portions parallel to such axis and extending between such openings. At lease one guide ramp is disposed longitudinally in the aperture between the planar wall portions on one lateral side of the aperture with the ramp projecting laterally inward so as to be longitudinally spaced from each of the planar wall portions and has at least its lower end lie in between them. The ramp has, for positioning severed articles, a laterally inward guide surface axially extending with a slanting towards the axis to the exit opening to render the exit opening of block "C" shape on the one lateral side. A punch is movable coaxially with the axis to enter the aperture, the front face of the punch having longitudinally-spaced parallel article-severing edges receivable with an article-severing fit within the aperture's planar wall portions. A cavity is formed in the punch extending rearwardly from the front face and of a size and shape to receive the ramp so as to enable the front face of the punch to pass through the aperature to the exit opening.

In a preferred embodiment of the invention, inserting means moves the axially aligned punch into the entrance opening and through the aperture to the exit opening such that as the punch is moved into the entrance opening the lower surface of the punch comes into contact with and pushes the article located between the punch and the aperture into the entrance end of the aperture thereby severing the connection between the article and the carrier, and as the punch is further inserted into the aperture the speed of the moving punch and the severed edge of the article rubbing against a non-tapered wall of the aperture cooperate to keep the article in contact with the lower surface of the punch thereby preventing the article from tumbling as it is moved through the aperture, such that as the severed article is pushed from the die the article is accurately positioned by the exit opening of the tapered aperture.

BRIEF DESCRIPTION OF DRAWINGS

The above described and other advantages and features of the invention will be more readily understood from the following detailed description when read in conjunction with the accompanying drawings, wherein.

DETAILED DESCRIPTION

Figure 1:
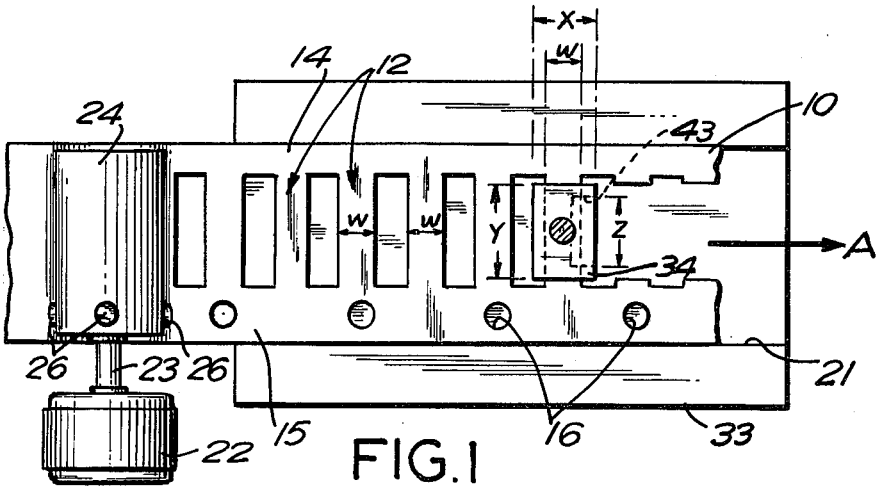
FIG. 1 is a plan view of a segment of a web containing a plurality of finger contacts.

Referring now to the figures and in particular to FIG. 1 there is seen a section of a web 10 containing a plurality of finger contacts 12. Web 10 is comprised of a virtually continuous, flat strip of electrically conductive material either punched or chemically etched to form finger contacts 12. Formed contacts 12 are held adjacent to one another on web 10 by carrier strips 14 and 15 in which positioning apertures, or pilot holes, 16 have been placed in strip 15 to aid in moving web 10.

Web 10 is moved along a track 21 by the action of stepping motor 22. One end of a drive shaft 23 is attached to motor 22 while a toothed drive wheel 24 is rotatably mounted on the other end of shaft 24. Teeth 26 are arranged such that they fit into and engage holes 16 of carrier 15 as web 10 is partially wound around drive 23 to move web 10 in the direction of arrow A each time wheel 24 is turned by drive shaft 23. Stepping motor 22, as the name implies, only partially turns wheel 24 each time it operates to advance, or step, web 10 along track 21. A stepping motor of the type described herein can be purchased from Superior Electric Co. of Briston, Conn.

Figure 2:
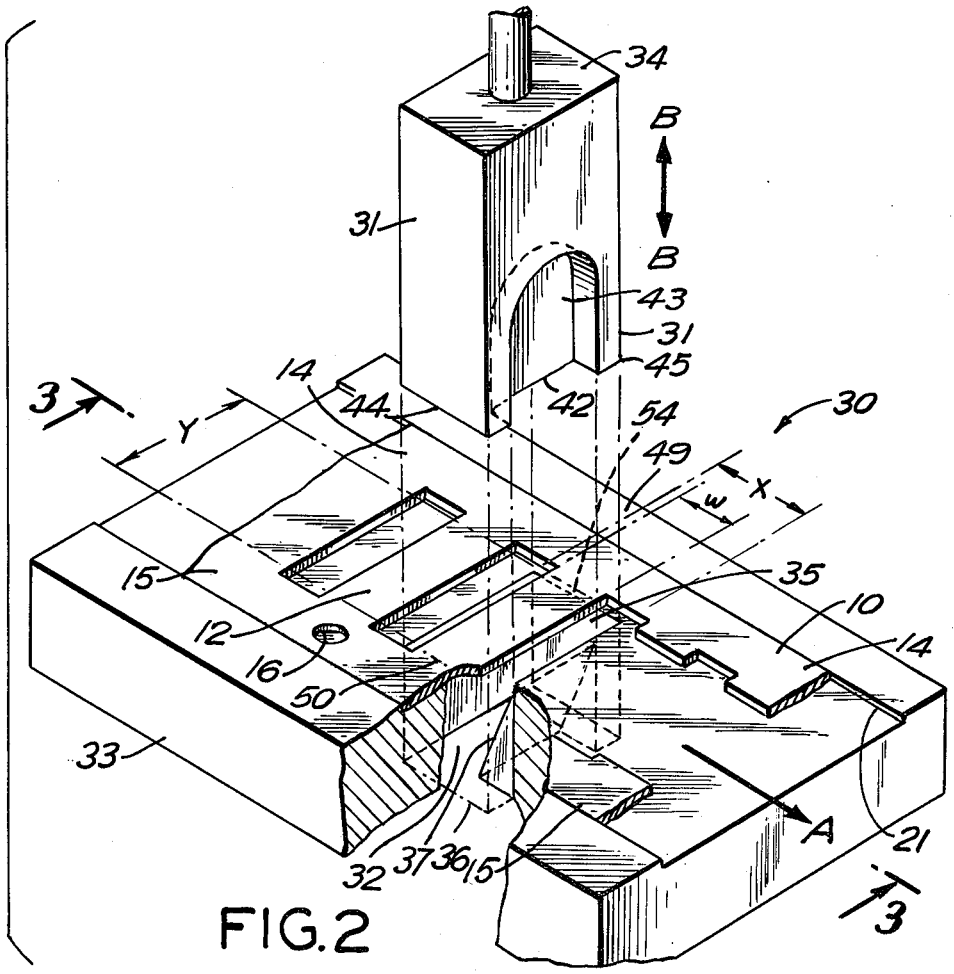
FIG. 2 is a perspective view of apparatus for severing a contact finger from the web and precisely positioning the severed contact finger from the web comprising a die and a punch positioned above the finger which is located over an aperture in the die.
Figure 3:
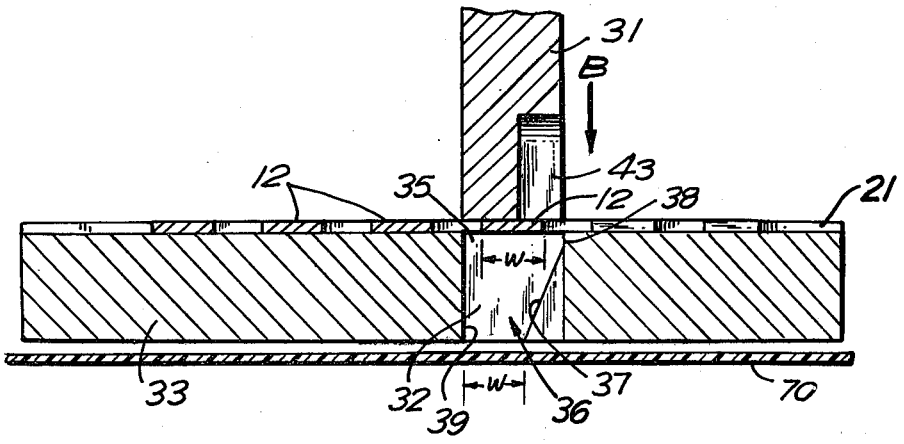
FIG. 3 is a horizontal section taken along line 3—3 of FIG. 2 showing the die and aperture.
Figure 5:
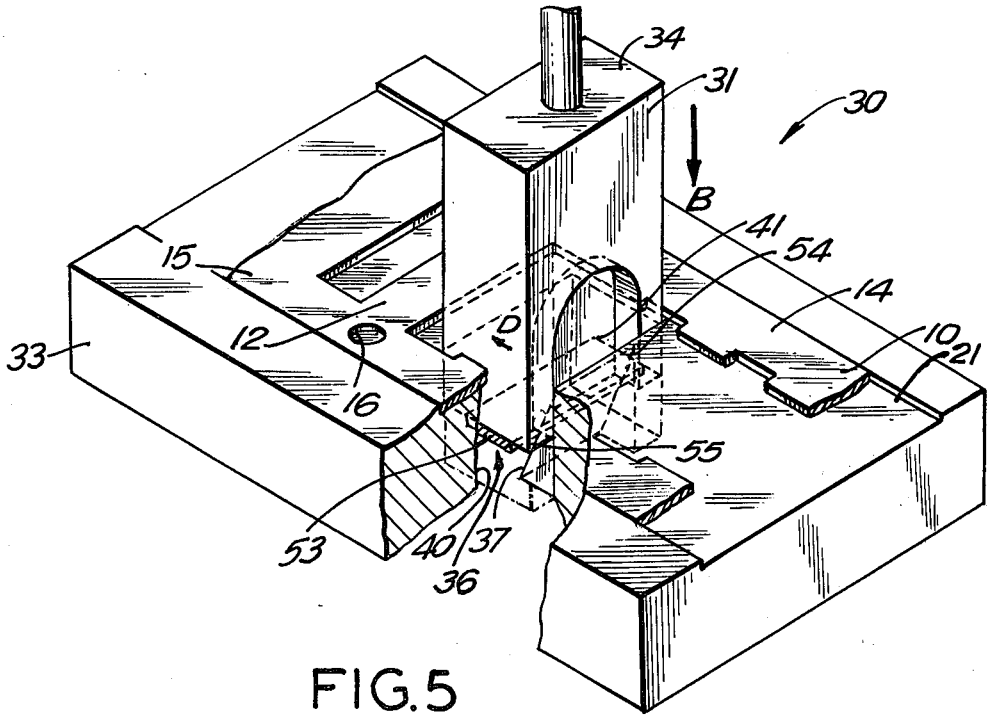
FIG. 5 is a perspective view similar to FIG. 2 but with a portion of the die cutaway showing the punch in the die.

Referring now to FIGS. 2–6 there is illustrated a complete apparatus 30 in accordance with a specific embodiment of the invention for severing a finger 12 from carriers 14 and 15 and for accurately positioning the severed finger. A finger 12 which is to be severed is moved by the action of stepping motor 22 along track 21 until it lies between punch 31 and aperture 32 (shown in the cutaway section of FIGS. 2 and 3) of die 33. Punch 31 is positioned in axial alignment with and arranged to closely fit and to move into and through aperture 32 as best seen in FIGS. 3 and 5. The top surface 34 of punch 31 is connected to a piston arm of a conventional piston and cylinder system (not shown) for moving punch 31 up and down in the direction of arrows B—B of FIGS. 2 and 5 which direction is that of the axis of the apparatus so as to be an axial coordinate thereof, and which direction further is substantially perpendicular to the movement of carriers 14–15 (arrow A) so as to sever a finger 12 from carriers 14–15 when the finger is placed between punch 31 and aperture 32.

As illustrated in FIGS. 1 and 2, entrance opening 35 of aperture 32 has a larger width dimension X in the lateral coordinate of the apparatus than the width W of contact finger 12 to allow for variations in the location of a contact finger 12 with respect to placement beneath punch 31. Contact finger 12 cannot be precisely positioned beneath punch 31 because of variations in finger spacing which appear during manufacture of web 10, variations in the location of pilot holes 16 and variations in stepping motor drive 22 which variations all contribute to make precise positioning of a finger 12 beneath punch 31 uncertain. The length Y of aperture 32 in the longitudinal coordinate of the apparatus is exactly the same as the desired length of a severed finger 12 as seen in FIGS. 2 and 4.

Aperture 32, which extends through die 33 from entrance opening 35 to an exit opening 36, has a ramped shaped wall, or guide ramp, 37 located along one of its surfaces 38 as seen in FIGS. 2 and 3. Ramped shaped wall 37 is sloped to taper, or narrow, aperture 32 towards exit end 36 such that exit opening 36 has a width W which extends between the end of wall 37 and the opposite surface 39 of aperture 32 as seen in FIG. 3. Width W at exit opening 36 is the same dimension as width W of finger 12, as seen in FIG. 3, to permit accurate passage of a severed finger 12 from die 33 through opening 36.

Figure 4:
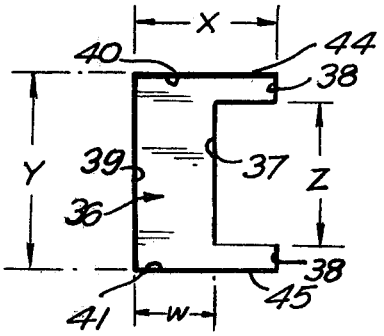
FIG. 4 is bottom view of the exit opening of the aperture.
Figure 6:
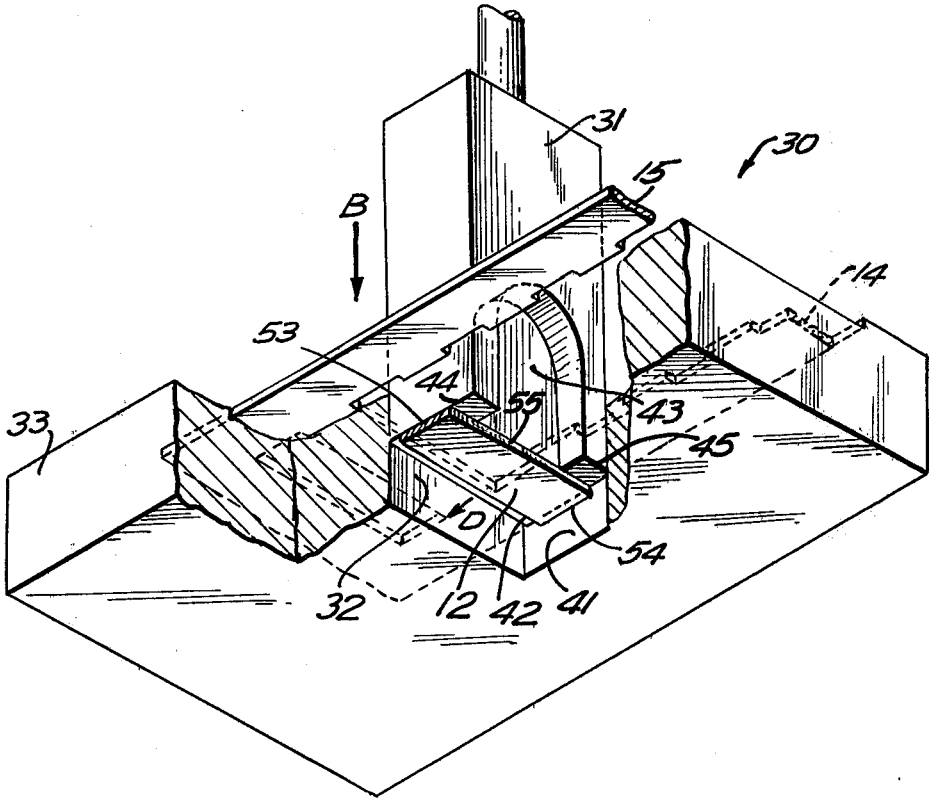
FIG. 6 is a perspective view of the apparatus as viewed from underneath the apparatus with a portion of the die cutaway showing a severed finger being moved down through the aperture in the die.

Ramped shaped wall 37 extends only partially along surface 38 of aperture 32 for a distance Z as seen in FIG. 4. The remainder of surface 38, that is the portions extending between ramped wall 37 and surfaces 40 and 41, is non tapered. Thus the extension of ramped shaped wall 37 into aperture 32 toward exit opening 36 combined with non tapered surfaces, or walls, 38, 39, 40 and 41 of aperture 32 form a rectangular C shaped opening at exit opening 36 as seen in FIG. 4. That is, such opening is in the shape of a "C" which is rectangular in the sense that the upper and lower parts of the "C" are joined to the center part thereof at angles which may be or approximate right angles. Punch 31 has a cavity 43 for accepting ramped wall 37 as punch 31 is inserted into aperture 32. Cavity 43 is of sufficient depth and height to allow punch 31 to be inserted entirely into aperture 32 without having ramped shaped wall 37 impede punch 31 during insertion as best seen in FIGS. 5 and 6. The bottom surface 42 of punch 31 has a rectangular C shape similar to the shape of exit opening 36 and dimensioned to fill opening 36 when punch 31 is fully extended into aperture 32. Thus the movement of punch 31 into aperture 32 with ramped shaped wall 37 moving into cavity 43 of punch 31 moves a severed finger 12 toward the width W of exit opening 36. The block C shaped bottom surface 42 of punch 31 finally ejects the severed finger 12 from die 33 through the width W in exit opening 36 as viewed in FIGS. 2 and 6. Walls 38, 39, 40 and 41 extend between entrance opening 35 and exit opening 36 in aperture 32 in parallel alignment with the axis of movement of punch 31.

Additionally, since cavity 43 extends only partially along one face of punch 31, punch 31 has two cutting edges 44, 45 (FIG. 2) which have a width slightly less than the width X of aperture 32 to insure that as punch 31 moves into aperture 32, cutting edges 44, 45 come into full contact with a finger 12 placed between punch 31 and aperture 32 as seen in FIG. 2 to completely sever finger 12 from carrier strips 14, 15

In a typical arrangement with a finger 12 having a width dimension W=0.070 inches (1.78 mm) and a length Y=0.340 inches (8.646 mm) aperture 32 would be X=0.113 inches (2.87 mm) wide to accommodate placement variations. Further die 33 typically has a depth of 0.31 (7.87 mm) and ramped wall 37 is placed at an angle O of approximately 8° with the vertical.

Although activation of motor 22 and punch 31 can be initiated by an operator manning apparatus 30, a typical arrangement would have both pieces of equipment under control of signals transmitted by common control equipment for example, a programmable computer. Equipment such as this is well known in the art and is readily available from numerous commercial sources such as Fluke, Inc. of Everett, Wash. and Hewlett Packard of Cupertino, Calif.

In order to better understand the present invention, the operation of apparatus 30 will now be described.

When a finger 12 is placed between punch 31 and aperture 32 as seen in FIG. 2, the piston-cylinder system (not shown) attached to punch 31 for moving punch 31 in direction of arrows B—B of FIG. 2 is activated to move punch 31 downward toward finger 12 and entrance 35 of aperture 32. As punch 31 moves downward, lower surface 42 of punch 31 comes into contact with finger 12 and attempts to push finger 12 into aperture 32. Since finger 12 is positioned over aperture 32 and since carriers 14 and 15 are not located over aperture 32 but are instead supported by die 33, the downward stroke of cutting edges 44, 45 punch 31 severs finger 12 from carriers 14 and 15 where finger 12 joins carriers 14 and 15 as shown by dotted lines 49, 50 in FIG. 2. As previously noted the width dimension X (FIG. 2) of punch 31 is sufficiently wider than the width W of finger 12 such that cutting edges 44, 45 of punch 31 make full contact with finger 12 even when finger 12 is not positioned in a precise location over aperture 32.

After severing finger 12 from web 10, punch 31 continues on its downward stroke in the direction of arrow B FIG. 6 and enters the entrance opening 35 of aperture 32 with ramped shaped wall 37 fitting into cavity 43 of punch 31. The downward speed of punch 31 helps keep severed finger 12 in contact with lower surface 42 of punch 31 and as severed finger 12 enters entrance opening 34 of aperture 32, the severed ends 53, 54 rub against non tapered walls 40–41 of aperture 32. Additionally, side 55 of severed finger 12 makes contact with ramped wall 37 which wall moves finger 12 in the direction of arrow D as punch 31 continues its downward movement into aperture 31 as best seen in FIG. 6.

The rubbing action of severed ends 53, 54 against non-tapered walls 40–41 of aperture 32 and the contact which side 55 of severed finger 12 makes with ramped wall 37 in aperture 32 acting to resist the downward motion of punch 31, all cooperate to keep severed finger 12 in contact with bottom surface 42 of punch 31 thus preventing finger 12 from tumbling or rotating as it moves down aperture 32.

As punch 31 continues its downward stroke, ramped wall 37 pushes severed finger 12 in the direction of arrow D until punch 31 completes its downward stroke.

At this time severed finger 12 is positioned between the ramped wall 37 and the opposite surface 39 at exit opening 36 of aperture 32 as best seen in FIG. 6. Since the width W of exit opening 36 is the same as width W of severed finger 12, severed finger 12 is precisely positioned at the opening. A printed wiring board substrate or adhesive tape 70 can be placed under exit opening 36 for receiving the aligned finger as seen in FIG. 3. Thus the operation of apparatus 30 has severed a contact finger 12 from web 10 and has accurately positioned the severed finger.

It will also be apparent that one skilled in the art may make various modifications and changes to the apparatus disclosed herein without departing from the spirit and scope of this invention.

What is claimed is:

1. Apparatus for severing and then positioning articles supplied by a carrier comprising:

a die having an aperture extending axially therethrough between entrance and exit openings of the aperture, the aperture being bounded in its interior on longitudinally opposite sides of its axis by planar wall portions parallel to such axis and extending axially between such openings at least one guide ramp disposed in the aperture on one lateral side of the aperture, the ramp projecting laterally inward from that side towards the other lateral side of the aperture, and the ramp being positioned so as to be longitudinally spaced from each of the planar wall portions and to have at least its lower end lie in between them, the ramp having, for positioning severed articles, a guide surface disposed to face towards such other lateral side of said aperture and axially extending from a part of said ramp axially away from said exit opening to the exit opening to render the exit opening of rectangular "C" shape on said one lateral side, said guide surface having a slant to said axis to approach closer to said other lateral side as said surface approaches closer to said exit opening; and a punch movable coaxially with the axis to enter the aperture, the front face of the punch having longitudinally-spaced parallel article-severing edges receivable with an article-severing fit within the aperture's planar wall portions, and the punch having formed therein on said one lateral side of the aperture a cavity extending rearwardly from the front face and of a size and shape to receive the ramp so as to enable the front face of the punch to pass through the aperture to the exit opening.

2. Apparatus as recited in claim 1 wherein the entrance opening of the aperture is wider in the lateral direction than the width of the finger to accommodate a finger which is not precisely positioned between the two carriers and the lateral width between the end at the exit opening of the guide surface and the opposite lateral side of the aperture at the exit opening of the aperture is substantially the same as the lateral width of the severed finger to position the severed finger.

* * * * *